US010517387B2

(12) United States Patent
Konrad

(10) Patent No.: US 10,517,387 B2
(45) Date of Patent: Dec. 31, 2019

(54) BRUSH CAP

(71) Applicant: Savant GmbH, Baden Baden (DE)

(72) Inventor: Stefan Konrad, Baden Baden (DE)

(73) Assignee: SAVANT GMBH, Baden Baden (DE)

( * ) Notice: Subject to any disclaimer, the term of this patent is extended or adjusted under 35 U.S.C. 154(b) by 0 days.

(21) Appl. No.: 15/449,293

(22) Filed: Mar. 3, 2017

(65) Prior Publication Data

US 2017/0251800 A1 Sep. 7, 2017

(30) Foreign Application Priority Data

Mar. 4, 2016 (DE) ..... 10 2016 103 983

(51) Int. Cl.
*A46B 17/04* (2006.01)
*B44D 3/12* (2006.01)
*A46B 15/00* (2006.01)

(52) U.S. Cl.
CPC ..... *A46B 17/04* (2013.01); *A46B 15/0097* (2013.01); *B44D 3/125* (2013.01); *A46B 2200/1046* (2013.01); *A46B 2200/205* (2013.01)

(58) Field of Classification Search
CPC . A46B 17/04; A46B 15/0095; A46B 15/0097; A46B 15/0093; A46B 15/0048; A46B 2200/205; A46B 2200/1046
USPC ..... 206/361
See application file for complete search history.

(56) References Cited

U.S. PATENT DOCUMENTS 1,283,403 A * 10/1918 Eustis ..... A47K 1/09 206/209.1
1,934,316 A * 11/1933 Loomis ..... A46B 17/04 15/246
5,172,447 A * 12/1992 Tomm ..... A46B 5/0095 15/145
6,199,694 B1 * 3/2001 Van Diest ..... A46B 17/04 206/361
6,684,922 B1 * 2/2004 Alston ..... B67C 9/00 141/364
9,119,491 B2 * 9/2015 Robbins, III ..... A47G 23/0216
2003/0126712 A1 * 7/2003 Kosick ..... B05C 17/0222 15/248.2
2004/0148724 A1 * 8/2004 Katz ..... A46B 5/00 15/167.1
2006/0043097 A1 * 3/2006 Tulp ..... A47G 23/0216 220/737

(Continued)

FOREIGN PATENT DOCUMENTS

CN 204306285 U 5/2015
DE 4215896 C1 11/1993

(Continued)

OTHER PUBLICATIONS

Translation of Forster DE4215896C1.*

*Primary Examiner* — Mollie Impink
(74) *Attorney, Agent, or Firm* — Raymond J. Vivacqua; Steven L. Crane

(57) ABSTRACT

In a brush cap for protecting a hair bundle of a cosmetic and/or paint or artist's brush, in order to obtain a more flexible application also for a plurality of brushes or for different brush shapes, and for the purpose of broadening the range of application of the brush cap, it is provided that a second end of the brush cap, through which a brush shaft, given proper use of the brush cap, projects, is configured such that it is radially expandable.

16 Claims, 2 Drawing Sheets

(56) References Cited

U.S. PATENT DOCUMENTS

2007/0056130 A1 3/2007 Baker et al.

FOREIGN PATENT DOCUMENTS

JP 3133139 B2 2/2001
KR 20150001396 U 4/2015

* cited by examiner

BRUSH CAP

INTRODUCTION

The invention relates to a brush cap, in particular for make-up or paint brushes or artist's brushes, having a first open end for the insertion of a brush or for slipping over the brush in a brush feed-in direction P and having a second open end lying opposite the first open end, wherein the second open end, given proper use of the brush cap, after the brush has been inserted or after the brush cap has been slipped over the brush, comes into contact with the brush shaft and clampingly embraces this same. The invention further relates to a system comprising a brush cap and a supplementary part functionally tailored to the brush cap.

BACKGROUND

Brush caps are slipped over the hair bundle of a brush, insulate the hair bundle of the brush from the environment and in this way protect, on the one hand, the hair bundle itself from pollution from outside and, on the other hand, the environment, for instance the inside of a toiletries bag, from pollution by the brush owing to make-up or paint residues remaining on the hair bundle. Brush caps of this type are hence used in particular as brush protection caps. Brush caps can further have the function of tightly enclosing the hair bundle, and thus of holding it in shape and protecting it from mechanical influences from outside. Protective caps for make-up brushes are known per se from the prior art.

For instance, Japanese Utility Model Specification JP 3133139 U discloses a protective cap for make-up brushes, in which a multipart protective cap is expandable in a jaw-like manner against a spring-loaded hinge, or a one-piece protective cap against its own material elasticity, in order to embrace the hair bundle of the brush.

A drawback with the aforementioned brush protection caps is, inter alia, that the insertion of a plurality of brushes simultaneously into one and the same cap is not possible, or is possible only with great difficulty. In particular, a secure hold on a plurality of brushes in one and the same protective cap cannot readily be ensured. Nor, because of its design, does such a brush cap aid the user in the handling of the brush by taking over further helpful functions. As a result of the necessary jaw-like expansion of the brush protection cap, it is difficult to ensure, in particular in the case of bushy brush forms, that the hair bundle is fully enclosed and parts of the hair bundle do not get stuck in the joint.

Also Utility Model Specification KR 20150001396 U discloses a brush protection cap for a cosmetic brush, wherein an additional closing lid, with which the first free open end of the brush cap can be closed off, can be provided. The brush protection cap is exactly matched to the shape and fullness of the individual brush or its hair bundle, so that the brush protection cap holds the hair bundle in shape, and the inner periphery of that end of the brush protection cap which comes into contact with the ferrule comes to bear tightly against the outer periphery of the ferrule. The use of such a protective cap for a differently shaped brush, or even for a plurality of brushes simultaneously, does not enter into consideration, owing to the exact matching of protective cap and brush.

A brush protection cap which is similar to the two aforementioned printed publications and which is accompanied, however, by similar drawbacks, is also disclosed by Chinese Utility Model or CN 204306285 U.

Based on this prior art, one object of the invention is to provide a brush cap for cosmetic brushes which enables more flexible application, including for a plurality of brushes, the use of which brush cap is not limited to a specific brush shape and the range of application of which, owing to its design, is broadened, in particular is capable of aiding the user, beyond the pure protective cap function, in respect of the work with the brush.

The objects are achieved according to the invention by virtue of the fact that the second end is configured such that it is radially expandable.

SUMMARY

The fact that the second end of the brush cap is radially expandable, thus in particular, starting from a center axis and irrespective of the basic cross section of the brush cap, is expandable from inside to out, ensures that one and the same brush cap can be employed in brush shafts of different thickness, or for a plurality of brushes simultaneously. The effective opening cross section of the passage opening formed by the second end adapts the diameter or number of the brush shafts projecting through the second end, when these have been previously inserted in a brush feed-in direction, with the end of the brush handle to the fore, via the first open end of the brush cap into the brush cap, or—in other words—when the brush cap has been slipped over the brush or brushes in the direction corresponding to the brush feed-in direction.

Preferredly, the radial expandability of the second end is realized by the fact that a second portion of the brush cap, which forms the second end, has a plurality of radially pliable expansion members distributed around the periphery of the brush cap. Expansion members of this type bend outward when load is applied from inside, by the insertion of a brush shaft, and subsequently—inter alia by virtue of their inherent material elasticity—bear in a play-free manner against the brush shaft or a plurality of brush shafts. Preferredly, at least three such expansion members are provided.

Alternatively to such expansion members, the second portion of the brush cap, which forms the second open end, as the second material portion of the brush cap, can also be formed by a an inherently elastic second material, for instance an elastomer, while the first portion, which forms the first open end of the brush cap, is formed by a first material portion consisting of a first material differing from the second material. The second material portion can also be formed by a net-like elastic structure exhibiting a multiplicity of meshes, which structure is capable of adapting, by deformation of the material and/or meshes, to the external dimension of an inserted brush shaft (or a plurality hereof).

The second portion—in particular if it is made of an elastic material—can have a closed surface and be of tubular configuration, wherein it can taper, viewed in a direction from the first end toward the second end. Insofar as it is made of an injection-moldable material, the second portion can be injection molded onto the first portion in a multi-component injection molding process. It can also be provided, however, that the entire brush protection cap is made of the material of which the second end consists.

Preferredly, the expansion members are formed, however, by finger-like expansion members (expansion fingers), which, starting from a base, extend in an axial direction away from the first end of the brush cap and, with a free end lying opposite the base, define the second open end of the brush cap and the passage opening for the brush shafts. The base of the finger-like expansion members is here formed by the region of the transition from a first undivided portion of the brush cap into the respective expansion member.

The expansion members, thus in particular the expansion fingers, extend preferredly also radially inward, starting from the base, or are curved also radially inward, starting from the base, so that the effective inner diameter of the brush cap decreases over the length of the finger-like expansion members in the region of the second portion, in the direction of the second end. The finger-like expansion members thus become narrower at increasing distance from the expansion member base, or taper to a point in the direction of the free end of the expansion fingers. From a design aspect, it is hereby enabled that the effective diameter of the brush cap, viewed in the brush feed-in direction, i.e. in a direction from the first open end in the direction of the second end of the brush cap, can taper.

It is in particular provided that the expansion members are an integral part, in particular materially integral part, of the brush cap.

In addition, it can advantageously be provided that in the second portion there is provided an elastic restoring means, which acts over the periphery of the brush cap and which is capable of positioning the expansion members, when a brush is inserted in the brush cap, against a brush shaft. The expansion members are in this way coupled to one another via an elastic restoring means. Beyond the elastic restoring force inherent to the material of the brush cap or of the expansion members, there can hereby be provided a restoring force which enables a significantly higher clamping force and a more effective clasping of one or more brush shafts inserted in the brush cap. In respect of the material of the brush protection cap itself, resort can then be made to less elastically acting materials and/or to smaller wall thicknesses, which can reduce and cheapen the material usage.

To this end, it can be provided that an expansion member is connected to hereto adjacent expansion members via respectively an elastic restoring means. In this context, it is in particular advisable that to provide the restoring means in the form of a plurality of short elastic band portions, which are segmentally configured and act between adjacent expansion members. An elastic band portion of this type, which acts between two in particular finger-like expansion members, can be injection molded within a multicomponent injection molding process onto the mutually adjacent expansion members (or the expansion members are injection molded onto an elastic band of this type).

It can also be provided that an in particular self-contained, one-piece elastic restoring means is placed around the expansion members. To this end, on the expansion members, in particular on the outside, can be provided one or more elevations, for instance in the form of material beads, which, over the periphery formed by the expansion members in the region of the second portion, form a receiving groove or a retaining projection for a restoring means placed around the expansion members. The restoring means can in this case be a simple rubber band, an O-ring or similar.

Alternatively or additionally to the elastic restoring means, on the expansion members, in particular on the outward pointing surfaces thereof, can be provided additional stiffenings, which increase the resistance moment of the expansion members against a radial expansion of the second end. Such stiffenings can be formed, in particular, by beads or by material regions which point radially inward or outward and which extend from the in the axial direction along the expansion members. In an advantageous design, the expansion members have a T-shaped cross section, wherein the middle bar points inward or outward. In such a case, the middle bar forms a stiffening rib. The aim of such a measure is to increase the stiffness of the expansion members, and thus the restoring tendency thereof, and to prevent, or at least delay, a slackening due to wear.

In order to avoid the penetration of pollution into the feed-in opening defining the first open end of the brush cap, the brush cap can have a closing lid, with which the first open end of the brush cap can be closed off after the proper insertion of the brush. The closing lid can be arranged via a hinge, in particular a film hinge, on the brush cap, or else can be provided as a separate supplementary part, which can be mounted at the first end onto the brush cap, in particular such that it latchingly engages therewith.

In addition, the brush cap can be assigned a supplementary part which preferredly is separate from the brush cap and acts as a standing aid and into which the brush cap can be stood with the second end facing downward, which enables a brush to be placed upright into the brush cap during work with the brush. The standing aid can be configured cylindrically, in particular in the form of a unilaterally open cylinder, and preferredly has an inner diameter which is matched in such a way to the outer diameter of the brush cap in a supporting region which preferredly lies in the region of the expansion members, in particular in the region of the base of the expansion members, that the brush cap is capable of resting via the supporting region on the supplementary part, in particular on the open end thereof. A largely tilt-safe standing of the brush cap in the standing aid is thereby ensured. The supporting region on the brush cap is here formed by one or more material elevations, preferredly extending over the periphery of the brush cap, which widen the effective external dimension of the brush cap in the supporting region. Should the brush cap have a non-round cross sectional shape, for instance an elliptical or a rectangular cross sectional shape, the supplementary part and/or the supporting region are naturally correspondingly matched to this cross sectional shape of the brush cap.

The supplementary part can then, if its diameter (or the measurement of the other cross sectional shape) is correspondingly matched to the diameter (or the measurement of the other cross sectional shape) of the brush cap, also serve as a closing lid mountable onto the first open end of the brush cap. For this purpose, the supplementary part preferredly is an only unilaterally open, tube-stub-shaped body (of round, ellipsoidal, rectangular, . . . cross section), and the non-open side of the supplementary part, after having been properly mounted onto the brush cap, closes off the first end of this same.

A further advantage of this design is also that the supplementary part serves as a standing aid not only when the brush protection cap, with the second, expandable end to the fore, is inserted in the open end of the standing aid (the brush rests upright in the brush protection cap with upward facing hair bundle), but also when the brush, with the first end to the fore, is inserted in the standing aid then acting as a protective cap, for the standing aid can then, in reverse orientation, serve as a standing aid, wherein the brush or brushes is/are then, with the hair bundle hanging downward, accommodated in the brush cap and in the supplementary part, which latter then acts both as a standing aid and as a closing lid. It should be noted, however, that the brush cap, in an appropriate design such that the first end thereof spans an effective standing surface, can be placed on a surface also without a supplementary part, serving as a standing aid, with a brush and downward hanging hair bundle.

In order to enable the drainage of moisture when a brush, after washing, is inserted in the brush cap, on the closing lid or the standing aid, and/or on the brush cap itself, are provided openings or notches, which make it easier for moisture to be drained from the closing lid or the standing aid and/or the brush cap when this stands, with the first end directed downward, on a plane surface, or hangs down from a mounting. In such a case, the brush is found, with the hair hanging downward, in the brush cap, which facilitates a dripping of moisture from the hair bundle and, in particular, prevents the penetration of moisture into the ferrule or the gluing of the brush. However, such openings or notches, in particular in the closing lid, can also be omitted, for instance if it is intended that the closing lid should be used as a water vessel for the brush, for example in watercolor painting.

Preferredly, the brush cap is constituted by a plastics injection molded part, wherein any elastic restoring means acting on the expansion members can have been connected to the expansion members in particular in a multicomponent injection molding process, insofar as said restoring means does not exist as a separate component which in the second portion can be drawn up onto the brush cap.

In connection with the term "radially expandable", it should be noted that "radially" is meant in particular in the sense of "from in to out", and is not limited to round basic cross sectional shapes, in particular not to round basic cross sectional shapes in the region of the second end. Should the brush cap, for instance, have in the region of the second end an angular basic cross section, for example because this should be better matched to brush shafts of non-round cross section, then its expandability "from in to out" should likewise be construed as "radial expandability".

BRIEF DESCRIPTION OF THE DRAWINGS

Further details of the invention emerge from the following description of preferred illustrative embodiments with reference to the drawings, in which.

DETAILED DESCRIPTION

Figure 1:
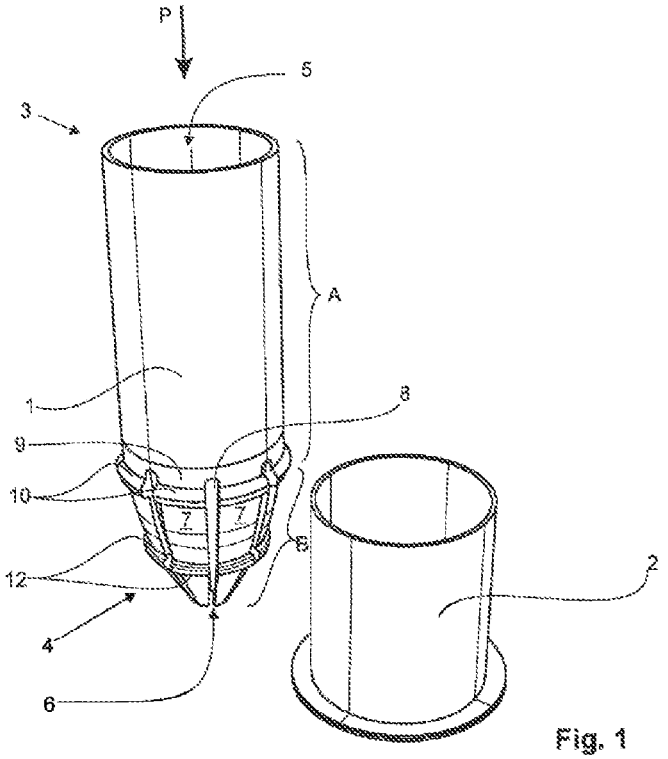
FIG. 1 shows a brush cap and a supplementary part separate from the brush cap, in a perspective view.
Figure 2:
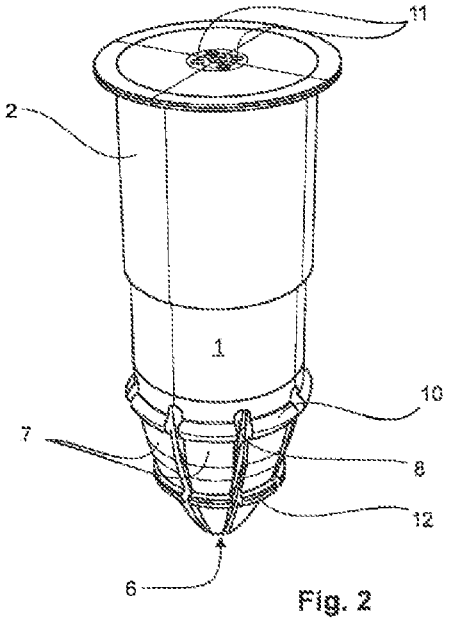
FIG. 2 shows the combination, shown in FIG. 1, of brush cap and supplementary part, in which the supplementary part is used as a closure cap.
Figure 3:
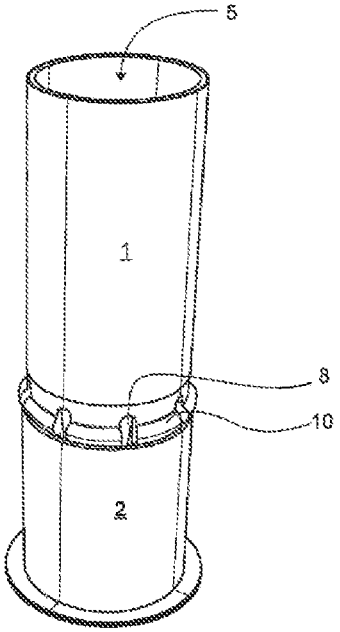
FIG. 3 shows the combination of brush cap and supplementary part which is shown in FIG. 1 and FIG. 2 and in which the supplementary part is oriented to hold upright a brush inserted in the brush cap, by accommodation of the brush cap in the supplementary part acting as a standing aid.

In FIGS. 1, 2 and 3, the combination of a brush cap 1 with a supplementary part 2 which can be used as a standing aid and/or closure cap is represented.

The brush cap 1 is formed in a first portion A by a cylindrical, peripherally closed main body, which—as can be seen in FIG. 1 and FIG. 3,—forms at a first open end 3 a feed-in opening 5. Lying opposite the open first end 3 is a second end 4 of the brush cap 1, wherein, coming from the direction of the first end 3, the first, cylindrical and peripherally closed portion A of the brush cap 1 is adjoined by a second portion B of the brush cap, which portion is peripherally interrupted by incisions 8 and tapers and the end of which finally forms the second end 4 of the brush cap 1 having a passage opening 6, through which, given proper use of the brush cap, a brush shaft is pushed in the brush feed-in direction P or over which the brush cap is slipped over the a brush shaft in the direction corresponding to the brush feed-in direction P. The brush feed-in direction P is parallel to an imaginary connecting line between the centroid of the feed-in opening 5 at the first end 3 and the centroid of the passage opening 6 at the second end 4, or even coincides with this connecting line, in particular when the brush cap 1, as shown in the figures, is configured as an axially or rotationally symmetrical component.

In the second portion B of the brush cap 1, which tapers in the direction of the second end 4, the outer wall region of the brush cap 1 is interrupted, with the formation of finger-like expansion members. These expansion fingers 7 are formed by preferredly axially oriented incisions 8*e*, which run toward the second end 4. The base 9 of the expansion fingers is formed by the transition from the first portion A to the second portion B of the brush cap 1.

As a result of this design of the second portion B of the brush cap, this portion is configured in a way which enables a radial expansion of the passage opening 6. The second end 4 or the effective width of the passage opening 6 is in this way capable of flexibly adapting to the periphery of a brush shaft or of a plurality of brush shafts fed through the passage opening 6, and of embracing these.

As is evident from FIGS. 1 to 3, in particular from FIG. 3,—preferredly in the region of the base of the expansion fingers or in the region of the transition from the first portion A to the second portion B—there is provided a supporting region 10 which is formed by an external elevation and which extends preferredly peripherally, albeit interrupted by the incisions 8, around the brush cap. The effective measurement of the supporting region 10 or of the material elevation forming this same, on the one, and the relevant effective measurement of the open end of the supplementary part 2 (in FIGS. 1 to 3 the corresponding effective diameters of supporting region and open end of the supplementary part) are mutually coordinated in such a way that the brush cap, with the second portion B of the brush cap to the fore, can intrude up to the supporting region 10 into the supplementary part, so that the latter acts as a standing aid. A brush which, with reference to FIG. 3, has been inserted with the brush shaft from above into the brush cap can in this way be inserted into the brush cap in a simple and, in particular, temporarily upright manner, and thus at all times again in a ready-to-hand state, and can also easily be removed again from said brush cap.

Alternatively to the use represented in FIG. 3, the supplementary part 2, given appropriate coordination of the relevant measurements of brush cap and supplementary part, can also serve as a closure cap. In the illustrative embodiment shown in FIG. 2, it can be seen that the supplementary part 2 is slipped over the first open end 3 of the brush cap and thus serves as the closing lid of the brush cap. In this way, the hair bundle of the brush cap can be insulated from the environment.

Of course, that orientation of the combination of brush cap 1 and supplementary part 2 which is shown in FIG. 2 can also be reversed, so that the brush cap 1 is accommodated with its first open end 3 directed downward in the supplementary part 2 standing, for example, with the closed end on a support surface, so that one or more brushes inserted in the brush cap, with the hair bundle hanging downward, can be deposited on a plane surface. The closed end of the supplementary part 2, which in FIG. 2 is directed upward, then forms a standing surface. The supplementary part can hence serve simultaneously both as a closure cap and as a standing aid.

In FIG. 2, it is further apparent that, in the closed end of the supplementary parts 2, openings 11 are provided. In conjunction with the incisions 8, these openings 11 enable, on the one hand, good ventilation of the space which is enclosed by supplementary part and brush cap and accommodates the hair bundle of the brush, and thus good drying of an accommodated moist hair bundle. On the other hand, such openings enable the drainage of any moisture which might drip down from the hair bundle after washing.

In the second portion B of the brush cap 1, a further circumferential elevation 12, which serves as a retaining projection for an elastic restoring means (not shown in FIGS. 1 to 3), is additionally apparent. Its function will become clear from the description of FIG. 5 which follows further below.

Figure 4:
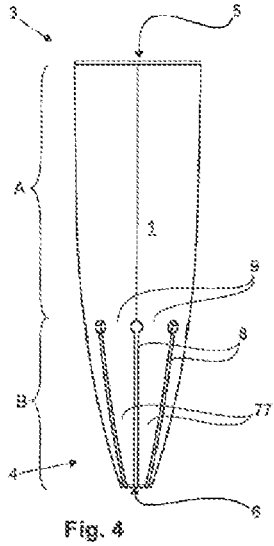
FIG. 4 shows a further embodiment of the invention, which is simplified in relation to FIG. 1.

FIG. 4 shows an embodiment of the invention which is simplified in comparison to the embodiment shown in FIGS. 1 to 3. Here the expansion fingers 7 are not provided with elevations which serve as a supporting region or retaining projection, nor is there provided a supplementary part which serves as a standing aid or closing lid. A brush cap of this type is a simple embodiment, which, however, nevertheless realizes the fundamental advantages of the invention and which lends itself as a variant which can be offered particularly cheaply and is simple to produce.

Figure 5:
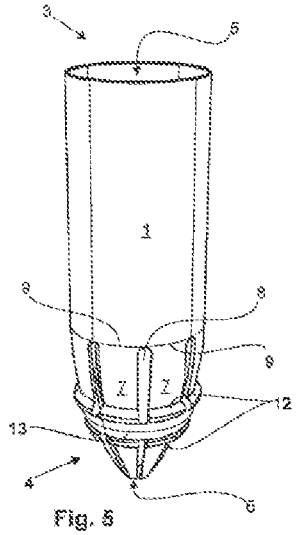
FIG. 5 shows a further embodiment of the invention, in which an elastic restoring means acts on expansion members.

In the embodiment represented in FIG. 5, on the outside of the expansion fingers are provided elevations 12, which in the second portion B of the brush cap form a receiving groove which runs over the periphery and by means of which an elastic band 13 that is placed around the expansion members 7 and serves as restoring means is held in position. This elastic band 13, which preferredly consists of an elastomer or similar material and which in the simplest case is a rubber band or an O-ring, increases the clamping force which is obtainable via the expansion fingers and which, after the insertion of a brush shaft into the passage opening 6 at the second end 4 of the brush cap 1, owing to the radial expansion of the brush cap 1 at this end 4, is exerted on the brush shaft, so that one or more brushes can be securely held and the brush cap 1 does not slip in relation to the brushes.

The receiving groove which in FIG. 5 is formed by the elevations 12 fulfils the same function as the retaining projection formed in FIGS. 1 to 3 by the elevations 12, wherein the retaining projection, as a retaining means which, in contrast to a receiving groove, acts only in one direction, due to the (in the direction of the first end) expanding periphery of the brush cap, should generally be sufficient.

Figure 6:
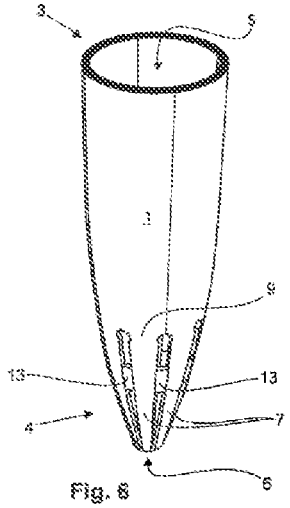
FIG. 6 shows a further embodiment of the invention, in which adjacent expansion members are respectively connected to one another via an elastic restoring means.

As an alternative to the elevations 12 provided on the outside of the expansion fingers 7, as the elastic restoring means can be provided, as illustrated by FIG. 6, also elastic band portions 13, which respectively extend from an expansion finger to an adjacent expansion finger via an incision 8 located between these expansion fingers. The effect of such an elastic restoring band which extends in some sections between adjacent expansion fingers is basically equivalent to the variant shown in FIG. 5, but has the advantage that the individual portions are fixedly connected to the expansion fingers and thus cannot get lost. Moreover, such an elastic restoring means, despite the more complex tools necessary for the manufacture (production using the 2-component injection molding process), is attachable to the brush cap in an automated manner within the production process in the same tool, in particular without tool change, and is fixedly connectable to the material of the rest of the brush cap.

Figure 7:
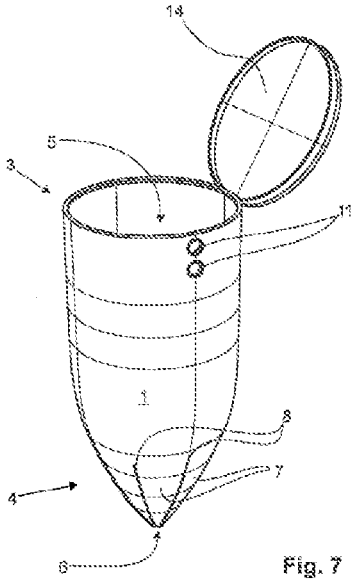
FIG. 7 shows an embodiment of a brush cap having a closing lid arranged pivotably on the brush cap.

FIG. 7 shows finally—in similarly simple construction as FIG. 4—a brush cap 1, on the basis of which it is intended to be illustrated that the brush cap 1 can also be assigned a closure cap 14, which, moreover, can be pivotably attached, for example, to the brush cap 1 (for example via a film hinge or other suitable measures). In the wall of the brush cap are provided openings 11, which, even with closed closure cap 14, promote a ventilation, and thus drying, of a brush accommodated in the brush cap 1. Such openings can of course—alternatively or additionally—be provided also in the closure cap 14.

Figure 8:
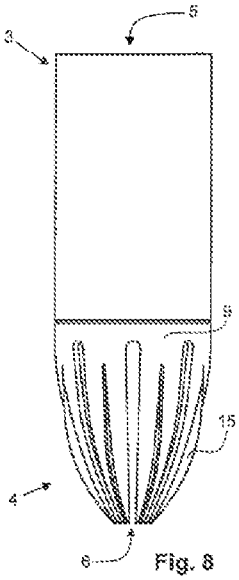
FIG. 8 shows an embodiment of a brush cap in which the expansion members have partially a T-shaped cross section with an outward facing stiffening rib.

FIG. 8 shows finally a further design variant of the brush cap, in which, on the outward facing side of the expansion members, additional stiffenings, in the form of reinforcing ribs 15, extending in the longitudinal direction of the expansion members is provided. These can also—differently than shown in the embodiment shown in FIG. 8—extend externally beyond the base 9 of the expansion members 7 in the direction of the first end of the brush cap. As a consequence of the provision of such reinforcements, the expansion members acquire, at least in part, a T-shaped basic cross section, with enhanced stiffness and increased restoring tendency.

The individual detailed features shown in the figures are not, of course, limited to the specific design variant shown in the respective figure, but can be readily transferred—where technically feasible and sensible—also to the design variants shown in other figures. Thus, for instance, that variant of an elastic restoring means which is shown in FIG. 6 can be used, of course, in the design variant shown in FIGS. 1 to 3, so that the elevations 12 serving as a retaining projection could there be dispensed with. Also the receiving groove which is formed by the elevations 12 in the embodiment according to FIG. 5 and which acts in both directions can be used in the design variant shown in FIGS. 1 to 3. The supporting region 10 shown in FIGS. 1 to 3 can naturally also be used in the embodiments shown in FIGS. 4 to 7, in particular together with a fitting supplementary part.

The basic idea of combining a brush cap with a further, separate supplementary part, which is tailored to the brush cap in such a way that it can be used as a standing aid, as well as the further idea of tailoring the supplementary part to the brush cap, in terms of design, such that it is capable of serving both as a standing aid and as a closing lid, are regarded, detached from the idea of configuring the second end of the brush cap such that it is radially expandable, as independent, separately claimable inventions.

Figure 9:
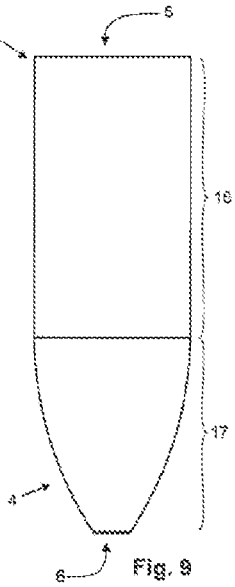
FIG. 9 shows an embodiment of a brush cap in which the second end is formed by a closed, elastic expandable material portion.

Alternatively to the brush caps, with finger-like expansion members, shown in the previous figures, as are illustrated in schematic representation by FIG. 9, a second material portion 17, forming the second open end 4, of the brush cap can be formed of an inherently elastic second material, for instance an elastomer, while the first material portion 16 forming the first open end 3 of the brush cap is formed of a first material differing from the second material. The second material portion can in this way, by deformation of the material, adapt to the outside measurement of an inserted brush shaft (or a plurality hereof) and cling in a frictionally engaged manner to the outer side of the brush shaft (or brush shafts).

As can be seen from FIG. 9, the second portion has a closed surface and is of tubular configuration, wherein it tapers viewed in a direction from the first end toward the second end. As also in the other figures, the second open end preferredly forms the place with the smallest passage cross section of the brush cap.

REFERENCE SYMBOL LIST

1 brush cap
2 supplementary part (combined standing aid/closure cap)
3 first end of the brush cap
4 second end of the brush cap
5 feed-in opening
6 passage opening
7 expansion fingers
8 incisions
9 base of the expansion fingers
10 supporting region
11 openings
12 elevations
13 elastic restoring means
14 closure cap
15 reinforcing rib
16 first material portion
17 second material portion
A first portion
B second portion
P brush feed-in direction

The invention claimed is:

1. A brush protection cap and supplementary component for accommodating and protecting a hair bundle of a make-up or artist's brush having:

a first portion forming a first open end of the brush protection cap and having a second portion forming a second open end of the brush protection cap, wherein the second portion of the brush cap is radially expandable and tapers in a direction from the first open end towards the second open end, and provide a passage opening at the second open end, characterized in that the second portion has a plurality of radially pliable expansion members and there is provided at least one of an elastic band and an elastic band portion, which are capable of urging the plurality of radially pliable expansion members, when a brush is inserted in the brush protection cap, against a brush shaft, and a supplementary component, which can be used as a standing aid and a closure lid, wherein i.) when mounted onto the first open end the supplementary component can serve as a closing lid and ii.) when the second open end of the brush protection cap is accommodated partially in the supplementary component, the supplementary component can provide a standing aid.

2. The brush protection cap and supplementary component according to claim 1, characterized in that the plurality of radially pliable expansion members are an integral part of the brush cap.

3. The brush protection cap and supplementary component according to claim 1, characterized in that the plurality of radially pliable expansion members are formed by expansion fingers, which, starting from a base, jointly define with their free ends facing away from the base a passage opening at the second open end of the brush cap.

4. The brush protection cap and supplementary component according to claim 1, characterized in that the plurality of radially pliable expansion members extend radially inward, starting from the base, and/or are curved radially inward, starting from the base.

5. The brush protection cap and supplementary component according to claim 4, characterized in that the plurality of radially pliable expansion members become narrower at increasing distance from the base.

6. The brush protection cap and supplementary component according to claim 1, characterized in that each of the plurality of radially pliable expansion members is connected to an adjacent one of the plurality of radially pliable expansion members respectively via the elastic band portion.

7. The brush protection cap and supplementary component according to claim 1, characterized in that the elastic band is placed around the plurality of radially pliable expansion members.

8. The brush protection cap and supplementary component according to claim 1, characterized in that one or more elevations are provided on each radially pliable expansion member, which, over a periphery formed by the plurality of radially pliable expansion members, form a retaining projection or, if at least elevations are present, form a receiving groove on the periphery for an elastic band placed around the plurality of radially pliable expansion members.

9. The brush protection cap and supplementary component according to claim 1, characterized in that on the outside of the brush protection cap, in the first portion or in the second portion, is formed by material elevations a supporting region, with which the brush protection cap is capable of resting on the supplementary component once the brush protection cap is accommodated, with the second open end to the fore, partially in the supplementary component.

10. The brush protection cap and supplementary component according to claim 1, characterized in that on each of the plurality of radially pliable expansion members a stiffening is provided.

11. The brush protection cap and supplementary component according to claim 1, characterized in that the radially expandable second open end is formed by an inherently elastic material.

12. The brush protection cap and supplementary component according to claim 1, characterized in that the first open end is formed by a first material portion made of a first material, and the second open end is formed by a second material portion made of a second material, wherein the second material is an inherently elastic material.

13. The brush protection cap and supplementary component according to claim 1, characterized in that the first open end is formed by a first material portion made of a first material, and the second open end is formed by a second material portion made of a second material, wherein the second material is an inherently elastic material and that the second portion is injection molded onto the first portion.

14. The brush protection cap and supplementary component according to claim 1, wherein the second portion has at least three radially pliable expansion members which are distributed around a periphery of the brush protection cap.

15. The brush protection cap and supplementary component according to claim 1, wherein the second portion of the brush cap further includes one or more material beads provided on the second portion, wherein each material bead forms a retaining projection for the elastic band placed around the plurality of radially pliable expansion members, so that the effective width passage opening at the second open end is radially expandable and the elastic band is capable of acting on the radially pliable expansion members.

16. The brush protection cap and supplementary component according to claim 1, wherein the elastic band portion extends in an incision between adjacent radially pliable expansion members, so that the effective width passage opening at the second open end is radially expandable and the elastic band portions are capable of acting on the radially pliable expansion members.

* * * * *